US012466020B1

(12) United States Patent
Wang

(10) Patent No.: US 12,466,020 B1
(45) Date of Patent: Nov. 11, 2025

(54) OSCILLATING SPINDLE SANDER WITH ROTARY COMPARTMENT DRUM

(71) Applicant: Duro Industries, LLC, Dover, DE (US)

(72) Inventor: Haiquan Wang, Qingdao (CN)

(73) Assignee: Duro Industries, LLC, Dover, DE (US)

( * ) Notice: Subject to any disclaimer, the term of this patent is extended or adjusted under 35 U.S.C. 154(b) by 0 days.

(21) Appl. No.: 18/974,846

(22) Filed: Dec. 10, 2024

(51) Int. Cl.
*B24B 7/07* (2006.01)
*B24B 1/04* (2006.01)
*B24B 21/00* (2006.01)
*B24B 27/02* (2006.01)

(52) U.S. Cl.
CPC ..... *B24B 7/07* (2013.01); *B24B 1/04* (2013.01); *B24B 21/00* (2013.01); *B24B 27/02* (2013.01)

(58) Field of Classification Search
CPC ..... B24B 27/03; B24B 21/00; B24B 1/04; B24B 27/02; B24B 7/07; B24B 47/16; B23Q 3/15722; B23Q 3/15766
USPC ..... 451/155, 411; 312/125
See application file for complete search history.

(56) References Cited

U.S. PATENT DOCUMENTS 1,448,253 A * 3/1923 Bodker ..... A47B 49/004 312/285
3,418,758 A * 12/1968 Mcewan ..... B24B 47/16 451/155
3,966,052 A * 6/1976 Knaus ..... B25H 3/04 211/163
4,258,962 A 3/1981 Slaugh
4,587,908 A * 5/1986 DeBruyn ..... A47B 49/006 108/142
5,549,507 A * 8/1996 Schroeder ..... B24B 41/04 451/157
5,597,275 A 1/1997 Hogan
5,860,852 A 1/1999 Hashii et al.
6,523,917 B2 * 2/2003 Twellmann ..... A47B 49/006 312/238
6,585,119 B2 * 7/2003 Palder ..... A47F 5/02 211/49.1
7,597,392 B1 * 10/2009 Gilmore ..... A47C 9/00 280/47.35
8,973,926 B1 3/2015 Lensing
9,717,360 B2 * 8/2017 Krull ..... A47G 29/14
(Continued)

OTHER PUBLICATIONS

State B-4 Spindle Sander Manual, accessed from "https://www.freemansupply.com/manuals/B4statesander.pdf", internet publication date of Oct. 2006 (Year: 2006).*

*Primary Examiner* — Makena S Markman
(74) *Attorney, Agent, or Firm* — Georgiy L. Khayet

(57) ABSTRACT

An oscillating spindle sander assembly and a method for manufacturing an oscillating spindle sander assembly are provided. The assembly includes an oscillating spindle sander. The oscillating spindle sander includes an oscillation generator, a drive shaft extending from the oscillation generator, and a table disposed above the oscillation generator and having an opening that accommodates the drive shaft. The oscillating spindle sander assembly further includes a rotary compartment drum rotatably mounted under the table and around the oscillation generator. The rotary compartment drum includes a plurality of storage compartments arranged around a circumference of the rotary compartment drum.

41 Claims, 15 Drawing Sheets

(56) References Cited

U.S. PATENT DOCUMENTS

| | | | |
|---|---|---|---|
| 2002/0009951 | A1 | 1/2002 | Smith et al. |
| 2009/0235789 | A1 | 9/2009 | Kielland |

* cited by examiner

OSCILLATING SPINDLE SANDER WITH ROTARY COMPARTMENT DRUM

TECHNICAL FIELD

This disclosure relates to oscillating spindle sanders. More specifically, this disclosure relates to oscillating spindle sanders with rotary compartment drums.

BACKGROUND

Oscillating spindle sanders are widely used in woodworking and metalworking industries to sand contoured surfaces. These machines typically come with multiple sanding drum sizes to accommodate various tasks. Standard sanding drum sizes supplied with oscillating spindle sanders may include ½", ¾", 1", 1½", 2", and 3".

When changing between different sanding drum sizes, an operator may be required to replace the sanding drum along with corresponding accessories, including a compatible drum washer and table insert. This process necessitates identifying the correct size for each component of the selected sanding drum.

Conventional oscillating spindle sanders do not provide a designated, organized storage solution for these accessories, which are based on their sizes. As a result, it is difficult for operators to quickly identify the correct sanding drum, drum washer, and table insert. Additionally, these accessories are typically stored in separate locations, further complicating and delaying the changeover process.

SUMMARY

This summary is provided to introduce a selection of concepts in a simplified form that are further described in the Detailed Description below. This summary is not intended to identify key features or essential features of the claimed subject matter, nor is it intended to be used as an aid in determining the scope of the claimed subject matter.

According to an example embodiment of the present disclosure, an oscillating spindle sander assembly is provided. The oscillating spindle sander assembly may include an oscillating spindle sander. The oscillating spindle sander may include an oscillation generator, a drive shaft extending outwards from the oscillation generator, and a table disposed above the oscillation generator and having an opening that accommodates the drive shaft. The oscillating spindle sander assembly may further include a rotary compartment drum rotatably mounted under the table and around the oscillation generator. The rotary compartment drum may include a plurality of storage compartments arranged around a circumference of the rotary compartment drum.

According to another embodiment of the present disclosure, a method for manufacturing an oscillating spindle sander assembly is provided. The method may commence with providing an oscillating spindle sander. The oscillating spindle sander may include an oscillation generator. The oscillating spindle sander may further include a drive shaft extending from the oscillation generator. The oscillating spindle sander may further include a table disposed above the oscillation generator and having an opening that accommodates the drive shaft. The method may proceed with providing a rotary compartment drum rotatably mounted under the table and around the oscillation generator. The rotary compartment drum may include a plurality of storage compartments arranged around a circumference of the rotary compartment drum.

Other example embodiments of the disclosure and aspects will become apparent from the following description taken in conjunction with the following drawings.

BRIEF DESCRIPTION OF DRAWINGS

Exemplary embodiments are illustrated by way of example and not limitation in the figures of the accompanying drawings, in which like references indicate similar elements.

DETAILED DESCRIPTION

Figure 1:
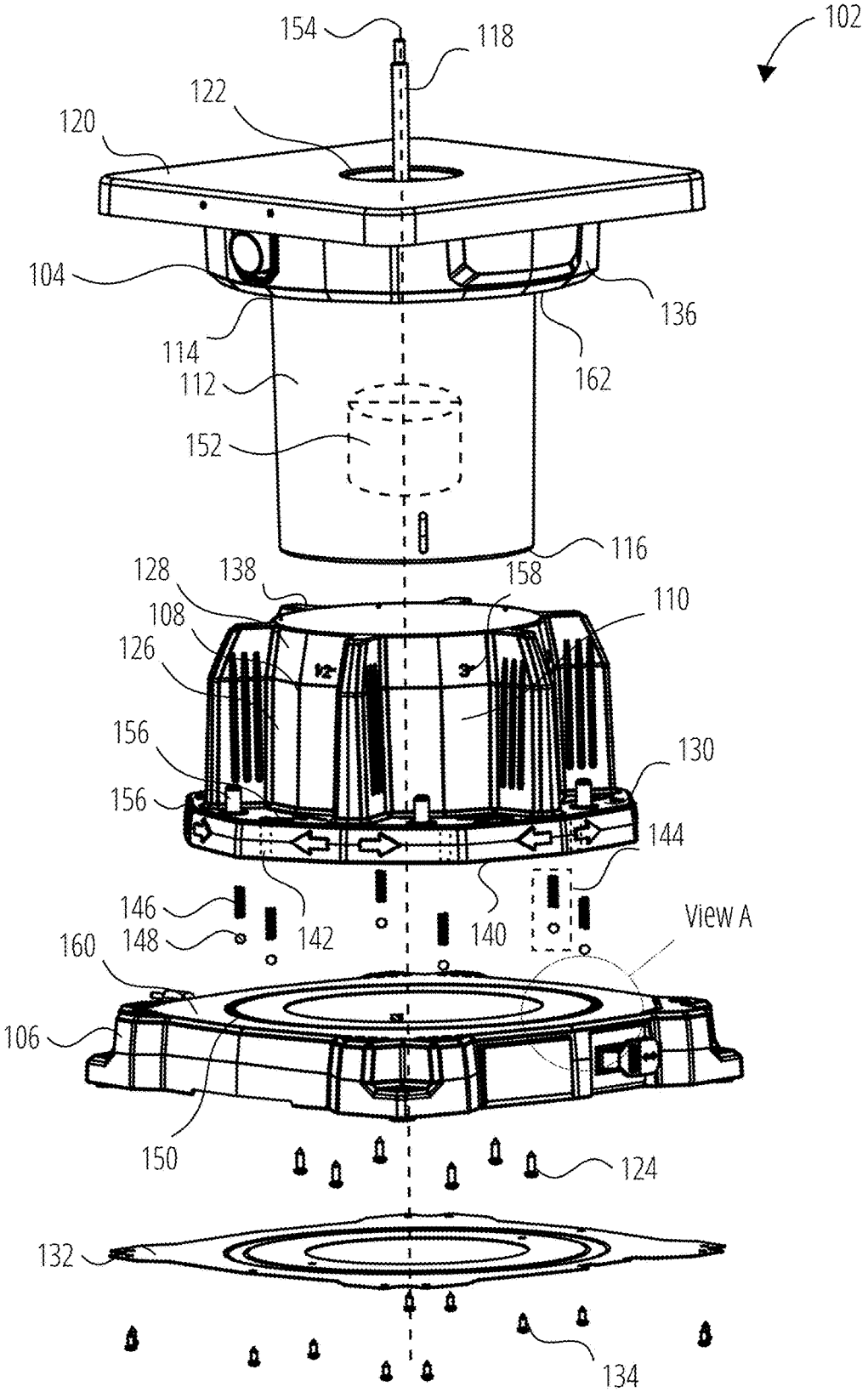
FIG. 1 is an exploded front perspective view of an oscillating spindle sander assembly, according to an example embodiment.

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical, and operational changes can be made without departing from the scope of what is claimed. The following detailed description is, therefore, not to be taken in a limiting sense, and the scope is defined by the appended claims and their equivalents.

Generally, the embodiments of the present disclosure relate to an oscillating spindle sander assembly. The oscillating spindle sander assembly may include an oscillating spindle sander and a rotary compartment drum. The oscillating spindle sander may include an oscillation generator and a drive shaft extending outwards from the oscillation generator. The oscillating spindle sander may further include a table disposed above the oscillation generator and having an opening accommodating the drive shaft. The rotary compartment drum may be rotatably mounted under the table and around the oscillation generator. The rotary compartment drum may include a plurality of storage compartments arranged around a circumference of the rotary compartment drum.

The oscillating spindle sander assembly provides a systematic solution for organizing and accessing various sizes of a sanding drum and their compatible drum washers and table inserts. All the accessories of the oscillating spindle sander assembly including a sanding drum, a drum washer, and a table insert of one size are stored in one storage compartment of the rotary compartment drum. An operator of the oscillating spindle sander assembly can easily turn the rotary compartment drum to bring accessories of desired sizes closer to the operator.

Referring now to the drawings, various embodiments are described in which like reference numerals represent like parts and assemblies throughout the several views. It should be noted that the reference to various embodiments does not limit the scope of the claims attached hereto. Additionally, any examples outlined in this specification are not intended to be limiting and merely set forth some of the many possible embodiments for the appended claims.

FIG. 1 is an exploded front perspective view of an oscillating spindle sander assembly 102, according to an example embodiment. The oscillating spindle sander assembly 102 may include an oscillating spindle sander 104 and a rotary compartment drum 108 mounted on the oscillating spindle sander 104. The rotary compartment drum 108 may include a plurality of storage compartments 110 arranged around a circumference of the rotary compartment drum 108.

The oscillating spindle sander 104 may include an oscillation generator 112 having a first end 114 and a second end 116. The oscillating spindle sander 104 may further include a drive shaft 118 extending outwards from the first end 114 of the oscillation generator 112. The oscillating spindle sander 104 may further include a table 120 disposed above the oscillation generator 112 and having an opening 122 accommodating the drive shaft 118.

The oscillating spindle sander 104 may include a base 106. The base 106 may be disposed under the oscillation generator 112. The oscillation generator 112 may be connected to the base 106. Specifically, the base 106 may be connected to the second end 116 of the oscillation generator 112. In an example embodiment, the base 106 may be connected to the second end 116 of the oscillation generator 112 via a plurality of first fastening components 124. In an example embodiment, the plurality of first fastening components 124 may include screws.

The rotary compartment drum 108 may be rotatably mounted under the table 120 and around the oscillation generator 112. In an example embodiment, the rotary compartment drum 108 may include a substantially cylindrical surface 126. In an example embodiment, a top portion 128 of the substantially cylindrical surface 126 may be narrowing in a direction towards a top end of the substantially cylindrical surface 126. The substantially cylindrical surface 126 may create a space inside the substantially cylindrical surface 126 for accommodating the oscillation generator 112. The rotary compartment drum 108 may further include a support portion 130 connected to a lower end of the substantially cylindrical surface 126. The support portion 130 may be provided along a circumference at the lower end of the substantially cylindrical surface 126.

The oscillating spindle sander assembly 102 may further include a bottom plate 132 connected to the base 106 via a plurality of second fastening components 134. In an example embodiment, the plurality of second fastening components 134 may include screws.

The oscillating spindle sander 104 may further include a resting member 136 disposed under the table 120. The resting member 136 may include a bottom surface 162 placed onto the rotary compartment drum 108. The rotary compartment drum 108 may be mounted in contact with the resting member 136. The rotary compartment drum 108 may include a top surface 138 facing the resting member 136. The top surface 138 of the rotary compartment drum 108 may be in contact with the bottom surface 162 of the resting member 136. The rotary compartment drum 108 may be mounted in contact with base 106 and include a bottom surface 140 placed onto the base 106.

The oscillating spindle sander assembly 102 may include a combination of components including a plurality of securing components 144 and a circular groove 150. The plurality of securing components 144 may include spring-loaded components that provide securing of the rotary compartment drum 108.

The plurality of securing components 144 may include a plurality of springs 146 and a plurality of balls 148. The location of the circular groove 150 and the plurality of securing components 144 with respect to the rotary compartment drum 108 may differ in various embodiments of the oscillating spindle sander assembly 102. Specifically, the combination of components including the circular groove 150 and the plurality of securing components 144 may be located on the top, in the middle (on an internal cylinder surface), and on the bottom of the rotary compartment drum 108. In every location, two example embodiments are provided, in one of which the circular groove 150 may be arranged on the rotary compartment drum 108, while in another example embodiment, the circular groove 150 may be provided on the coupling part (i.e., the resting member 136, the oscillation generator 112, or the base 106).

Figure 2A:
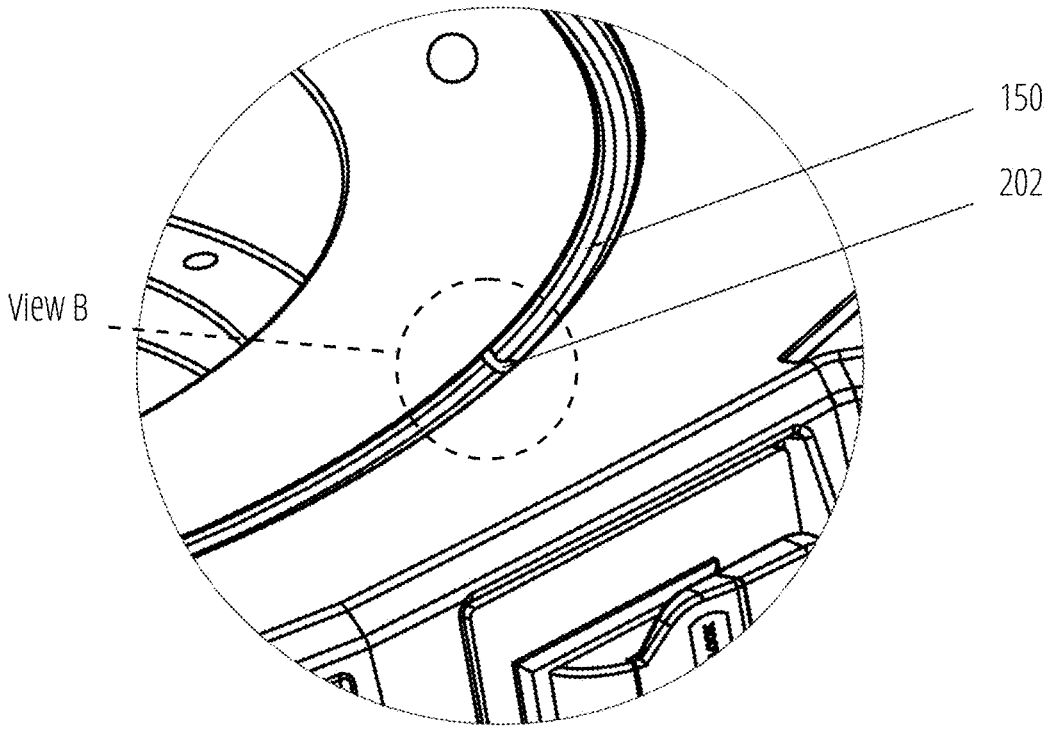
FIG. 2A is a partial view showing a circular groove of an oscillating spindle sander assembly, according to an example embodiment.
Figure 2B:
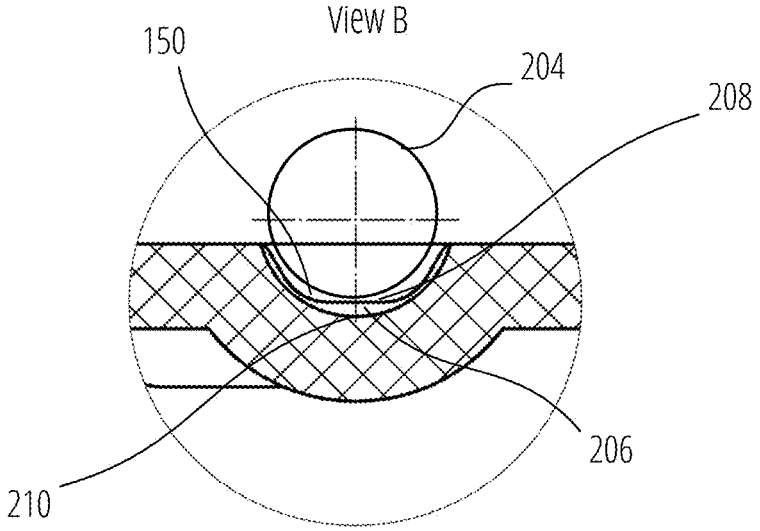
FIG. 2B is a partial cross-section view illustrating a dent, according to an example embodiment.

FIG. 1, FIG. 2A, and FIG. 2B illustrate an example embodiment, in which the circular groove 150 is located on the top of the base 106 and the plurality of securing components 144 is arranged on the bottom of the rotary compartment drum 108.

The rotary compartment drum 108 may further include a plurality of recesses 142 distributed along the bottom surface 140 of the rotary compartment drum 108. The rotary compartment drum 108 may further include a plurality of securing components 144 placed in the plurality of recesses 142. The plurality of securing components 144 may include a plurality of springs 146 and a plurality of balls 148. The plurality of springs 146 may be placed into the plurality of recesses 142 in the bottom surface 140 of the rotary compartment drum 108. The plurality of balls 148 may be placed on the plurality of springs 146 in the plurality of recesses 142. Accordingly, a spring 146 and a ball 148 may be inserted into each recess 142.

The base 106 may include a top surface 160 facing the rotary compartment drum 108. The rotary compartment drum 108 may include a bottom surface 140 facing the base 106. The bottom surface 140 of the rotary compartment drum 108 may be in contact with the top surface 160 of the base 106. The base 106 may include a circular groove 150 located on the top surface 160 of the base 106. The plurality of securing components 144 may sit on the circular groove 150 formed on the base 106.

The oscillating spindle sander assembly 102 further includes a motor and drive unit 152. The motor and drive unit 152 may be disposed in the oscillation generator 112 and may be configured to provide rotation and oscillation of the drive shaft 118 of the oscillating spindle sander 104.

FIG. 2A is a partial view A of FIG. 1 showing the circular groove 150 of the oscillating spindle sander assembly 102, according to an example embodiment. As shown in FIG. 2A, the base 106 may further include one or more dents 202 may be made in the circular groove 150. The one or more dents 202 may be evenly or unevenly distributed along the length of the circular groove 150. The one or more dents 202 may be deeper than the circular groove 150. In an example embodiment, the one or more dents 202 can have the shape of a hemisphere.

In some example embodiments, one or more holes may be provided in the circular groove 150 instead of the one or more dents 202.

The plurality of securing components 144 may sink inside the one or more dents 202 of the circular groove 150 and push the rotary compartment drum 108 away from the base 106 and toward the resting member 136. Specifically, with a securing component 204 supported by the circular groove 150, the rotary compartment drum 108 is pushed away from the base 106 and toward the resting member 136 of the oscillating spindle sander assembly 102.

FIG. 2B is a partial cross-section view B of FIG. 2A illustrating a dent 206 of the one or more dents 202 and a securing component 204 that rolls on a dented surface 208 of the circular groove 150, according to an example embodiment. The dent 206 may have a bottom side 210 deeper than the circular groove 150.

The rotary compartment drum 108 slides on the oscillation generator 112 of the oscillating spindle sander assembly 102, so the rotary compartment drum 108 rotates smoothly around the oscillation generator 112. Upon rotation of the rotary compartment drum 108 around the oscillation generator 112, a securing component 204 of the plurality of securing components 144 may rise out of a first dent of the one or more dents 202, roll along the circular groove 150, and sink inside a second dent of the one or more dents 202. Accordingly, with the rotation of the rotary compartment drum 108, the securing components 204 roll on the circular groove 150 until one of the securing components 204 sinks inside the dent 206 to hold a certain position of the rotary compartment drum 108. Rotating the rotary compartment drum 108 further forces the sunk securing component 204 to rise out of the dent 206 and continue to roll on the circular groove 150. The rotation of the rotary compartment drum 108 includes rotation of the plurality of storage compartments 110 around the oscillation generator 112.

In an example embodiment, only one dent 206 may be provided in the circular groove 150 but a plurality of securing components 144 may be provided in the plurality of recesses 142. With the rotation of the rotary compartment drum 108, a first securing component 204 may rise out of the dent 206, roll along the circular groove 150, and the second securing component 204 next to first securing component 204 may sink inside the same dent 206 upon a certain degree of rotation of the rotary compartment drum 108.

In an example embodiment, when sunk in the dent 206, the securing component 204 may contact the bottom side 210 of the dent 206. Moreover, when sunk in the dent 206, more than a half of the height of the securing component 204 may be out of the dent 206. This may allow the securing component 204 to rise out of the dent 206 upon exerting the force on the rotary compartment drum 108 in order to rotate the rotary compartment drum 108.

The rotation of the rotary compartment drum 108 includes rotation of the plurality of storage compartments 110 around the oscillation generator 112. Specifically, the plurality of storage compartments 110 are disposed along the circumference of the rotary compartment drum 108 and, when the rotary compartment drum 108 rotates around the oscillation generator 112, the plurality of storage compartments 110 also rotate around the oscillation generator 112 of the oscillating spindle sander 104. The rotation of the rotary compartment drum 108 around the oscillation generator 112 may include one of a clockwise rotation and a counterclockwise rotation. Accordingly, the rotary compartment drum 108 may be rotated clockwise or counterclockwise around a vertical axis 154 of the oscillating spindle sander assembly 102.

Figure 3:
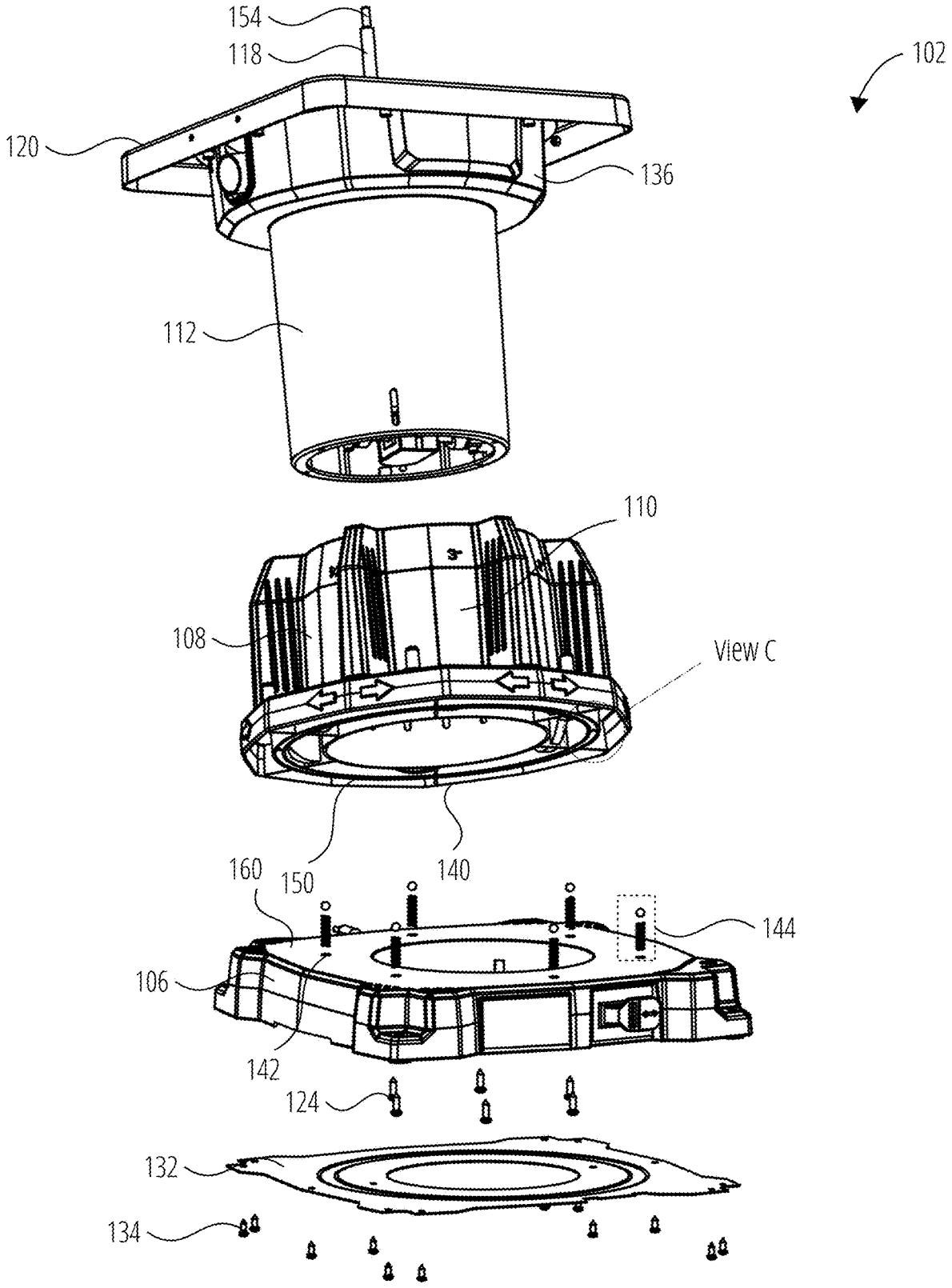
FIG. 3 is an exploded front perspective view of an oscillating spindle sander assembly, according to an example embodiment.
Figure 4A:
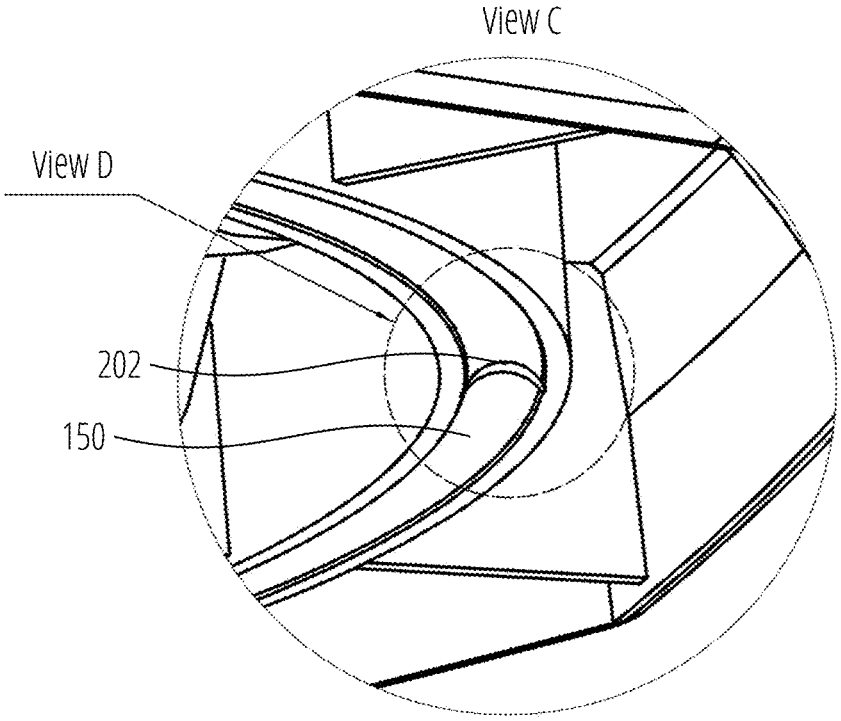
FIG. 4A is a partial view showing a circular groove of an oscillating spindle sander assembly, according to an example embodiment.
Figure 4B:
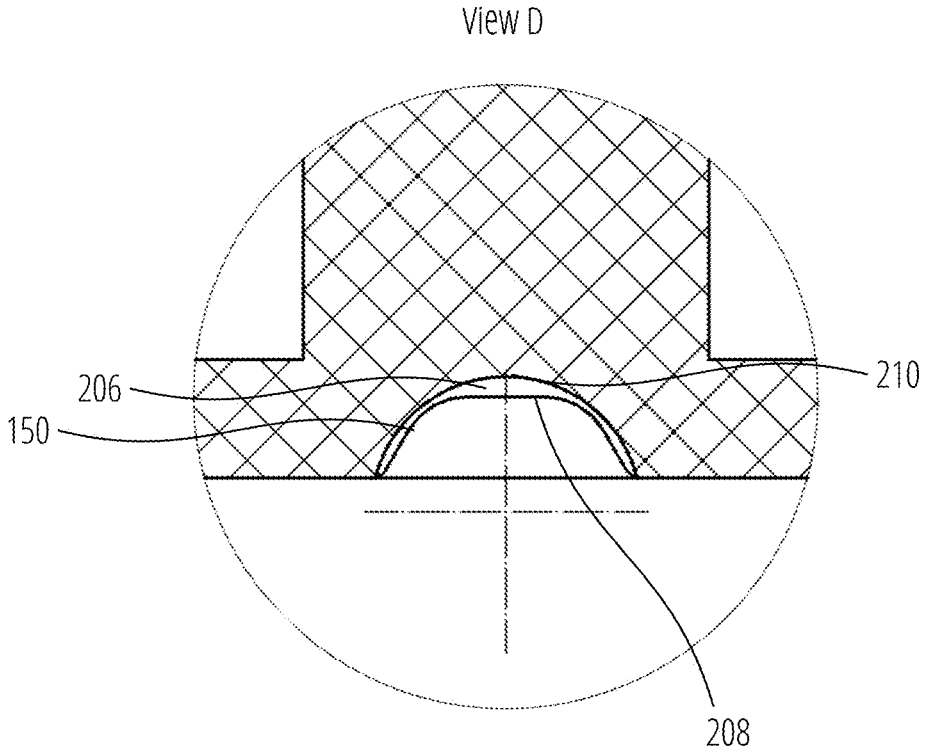
FIG. 4B is a partial cross-section view illustrating a dent, according to an example embodiment.

FIG. 3, FIG. 4A, and FIG. 4B illustrate an example embodiment, in which the circular groove 150 is arranged on the bottom of the rotary compartment drum 108. As shown in FIG. 3, the base 106 may include a plurality of recesses 142 distributed along the top surface 160. The plurality of securing components 144 may be placed in the plurality of recesses 142. The rotary compartment drum 108 may include the circular groove 150 made on the bottom surface 140 of the rotary compartment drum 108.

FIG. 4A is a partial view C of FIG. 3 showing the circular groove 150 made on the bottom surface 140 of the rotary compartment drum 108, according to an example embodiment. As shown in FIG. 4A, one or more dents 202 may be made in the circular groove 150. The one or more dents 202 may be evenly or unevenly distributed along the length of the circular groove 150. The one or more dents 202 may be deeper than the circular groove 150.

The plurality of securing components 144 may sink inside the one or more dents 202 of the circular groove 150 and push the rotary compartment drum 108 away from the base 106. The plurality of securing components 144 may include a plurality of springs placed into the plurality of recesses 142 and a plurality of balls placed onto the plurality of springs in the plurality of recesses 142.

FIG. 4B is a partial cross-section view D of FIG. 4A illustrating a dent 206 of the one or more dents 202, according to an example embodiment. The dent 206 may have a bottom side 210 deeper than the circular groove 150.

Upon rotation of the rotary compartment drum 108 around the oscillation generator 112, a securing component 204 of the plurality of securing components 144 rises out of a first dent 206 of the one or more dents 202, rolls along the circular groove 150, and sinks inside a second dent 206 of the one or more dents 202. The rotation of the rotary compartment drum 108 includes rotation of the plurality of storage compartments 110 around the oscillation generator 112.

Figure 5:
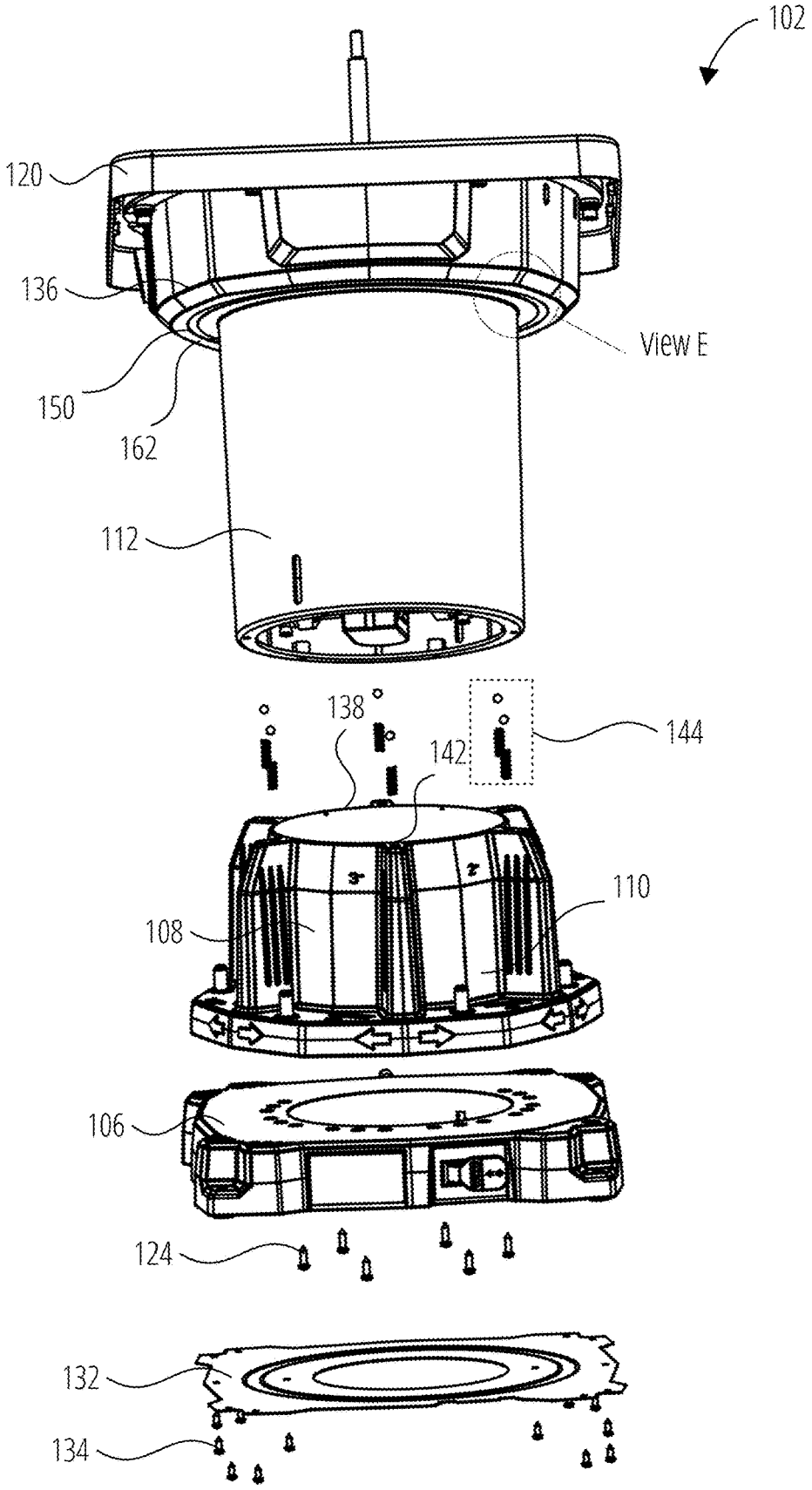
FIG. 5 is an exploded front perspective view of an oscillating spindle sander assembly, according to an example embodiment.
Figure 6A:
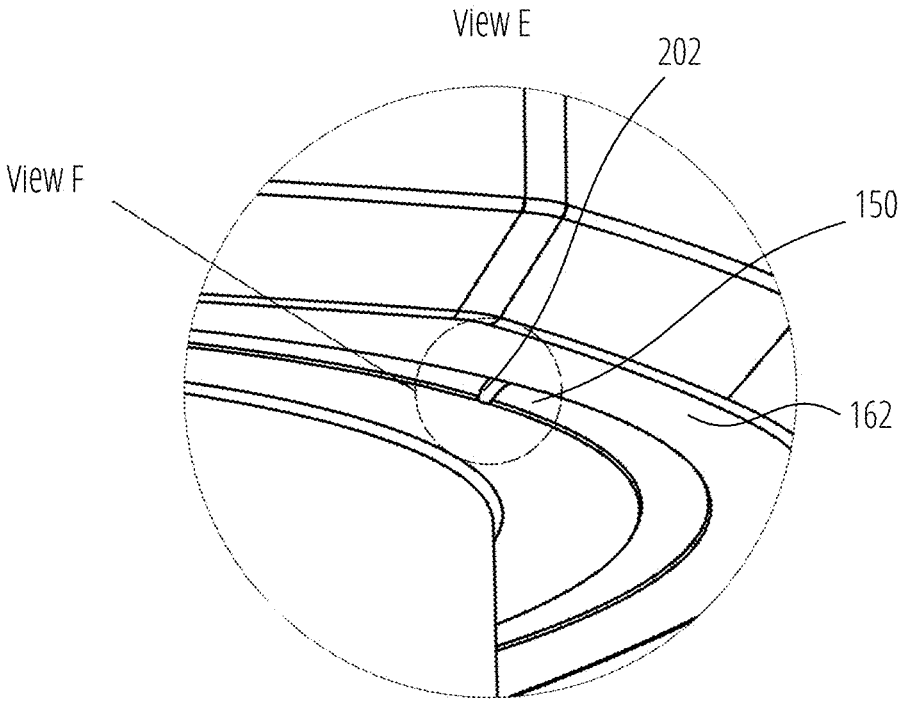
FIG. 6A is a partial view showing a circular groove of an oscillating spindle sander assembly, according to an example embodiment.
Figure 6B:
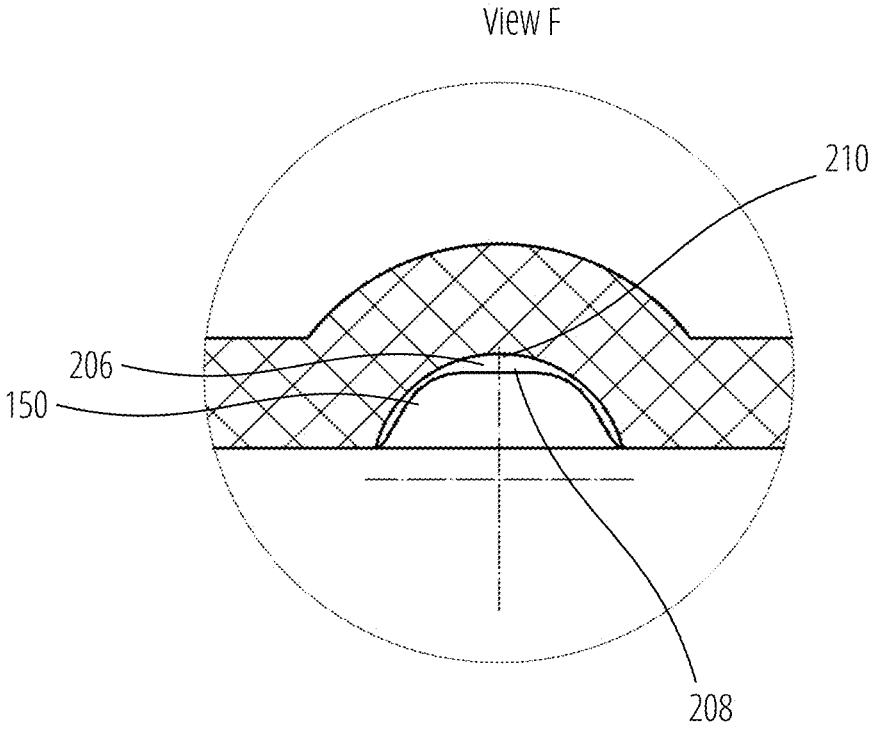
FIG. 6B is a partial cross-section view illustrating a dent, according to an example embodiment.

FIG. 5, FIG. 6A, and FIG. 6B illustrate an example embodiment, in which the circular groove 150 is arranged on the bottom of the resting member 136. As shown in FIG. 5, the resting member 136 may have the circular groove 150 made on a bottom surface 162 of the resting member 136.

FIG. 6A is a partial view E of FIG. 5 showing the circular groove 150 made on the bottom surface 162 of the resting member 136, according to an example embodiment. One or more dents 202 may be made in the circular groove 150.

The rotary compartment drum 108 may include a plurality of recesses 142 distributed along the top surface 138 of the rotary compartment drum 108. The plurality of securing components 144 may be placed in the plurality of recesses 142. The plurality of securing components 144 may sink inside the one or more dents 202 and push the rotary compartment drum 108 away from the resting member 136.

FIG. 6B is a partial cross-section view F of FIG. 6A illustrating a dent 206 of the one or more dents 202, according to an example embodiment. The dent 206 may have a bottom side 210 deeper than the circular groove 150.

Upon rotation of the rotary compartment drum 108 around the oscillation generator 112, a securing component 204 of the plurality of securing components 144 rises out of a first dent 206 of the one or more dents 202, rolls along the circular groove 150, and sinks inside a second dent 206 of the one or more dents 202. The rotation of the rotary compartment drum 108 includes rotation of the plurality of storage compartments 110 around the oscillation generator 112.

Figure 7:
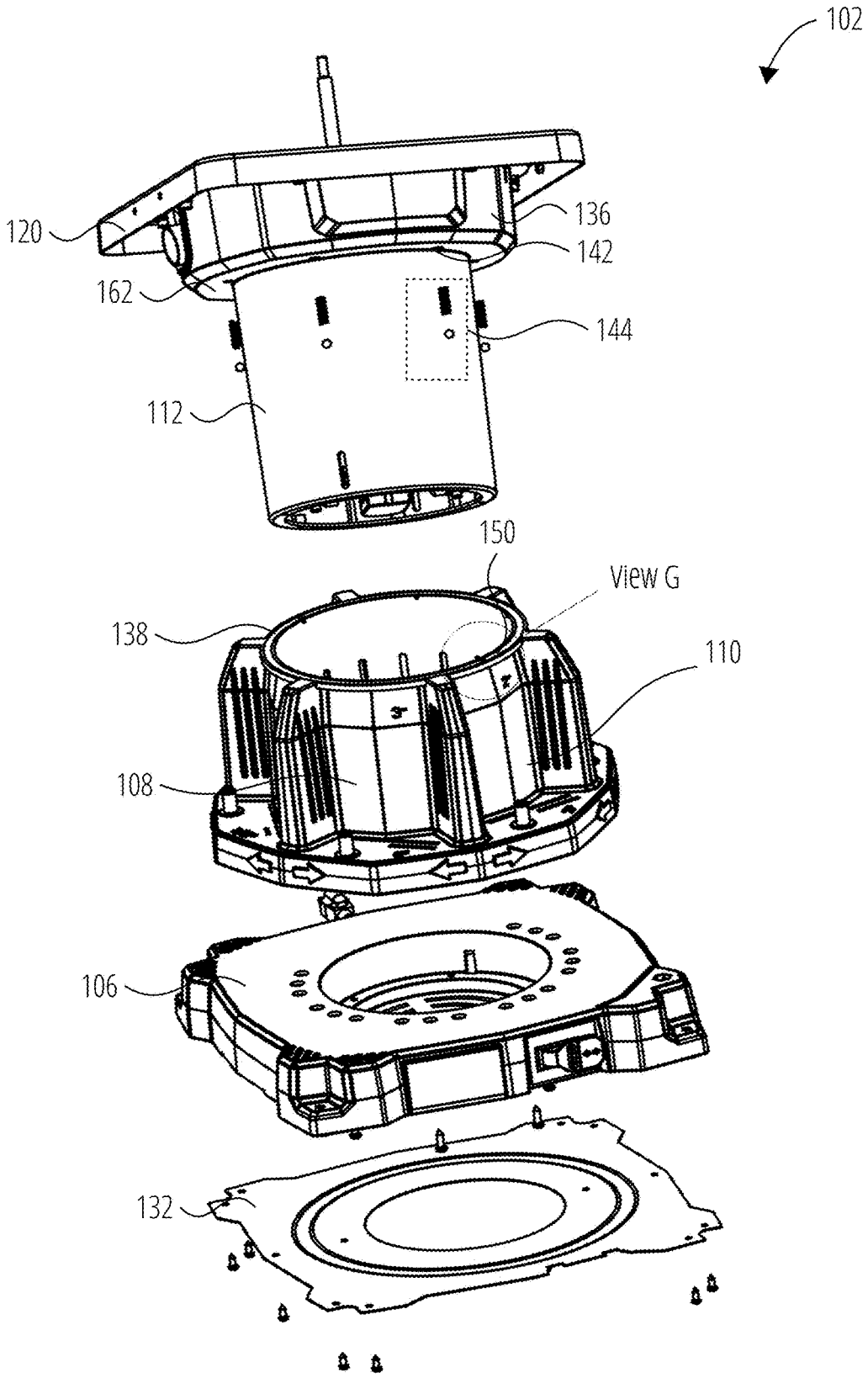
FIG. 7 is an exploded front perspective view of an oscillating spindle sander assembly, according to an example embodiment.
Figure 8A:
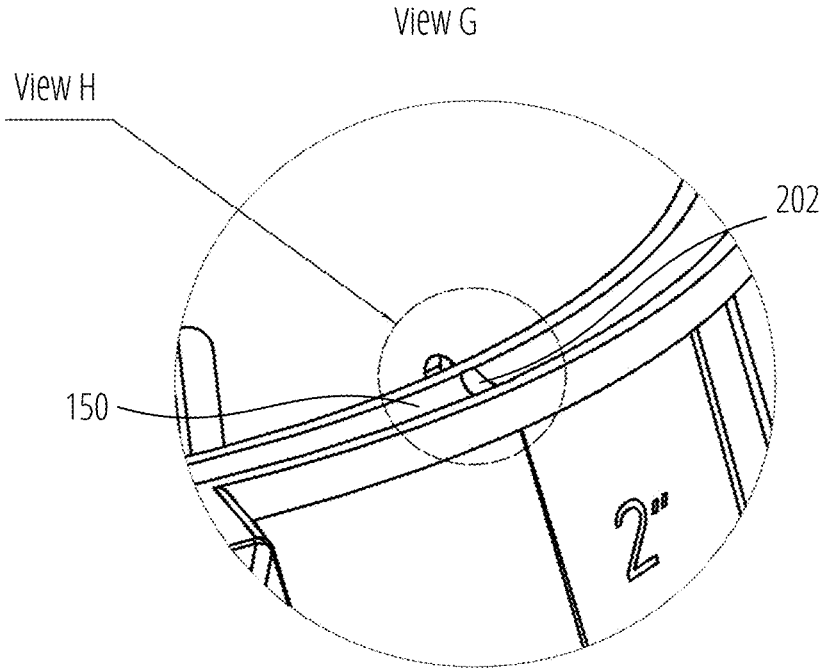
FIG. 8A is a partial view showing a circular groove of an oscillating spindle sander assembly, according to an example embodiment.
Figure 8B:
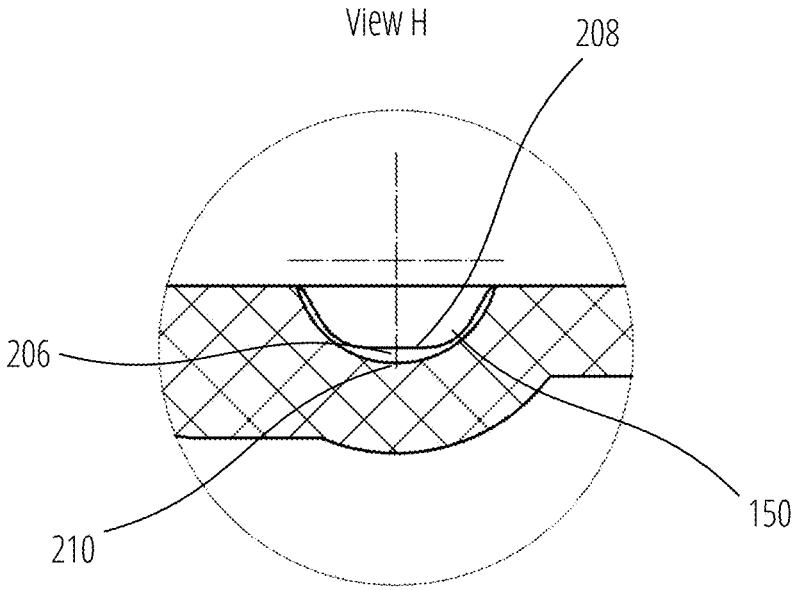
FIG. 8B is a partial cross-section view illustrating a dent, according to an example embodiment.

FIG. 7, FIG. 8A, and FIG. 8B illustrate an example embodiment, in which the circular groove 150 is arranged on the top surface 138 of the rotary compartment drum 108. The resting member 136 may include a plurality of recesses 142 distributed along a bottom surface 162 of the resting member 136. The plurality of securing components 144 may be placed in the plurality of recesses 142.

FIG. 8A is a partial view G of FIG. 7 showing the circular groove 150 made on the top surface 138 of the rotary compartment drum 108, according to an example embodiment. The rotary compartment drum 108 may further include one or more dents 202 made in the circular groove 150. The plurality of securing components 144 may sink inside the one or more dents 202 and push the rotary compartment drum 108 away from the resting member 136.

FIG. 8B is a partial cross-section view H of FIG. 8A illustrating a dent 206 of the one or more dents 202, according to an example embodiment. The dent 206 may have a bottom side 210 deeper than the circular groove 150.

Upon rotation of the rotary compartment drum 108 around the oscillation generator 112, a securing component 204 of the plurality of securing components 144 rises out of a first dent 206 of the one or more dents 202, rolls along the circular groove 150, and sinks inside a second dent 206 of the one or more dents 202. The rotation of the rotary compartment drum 108 may include rotation of the plurality of storage compartments 110 around the oscillation generator 112.

Figure 9:
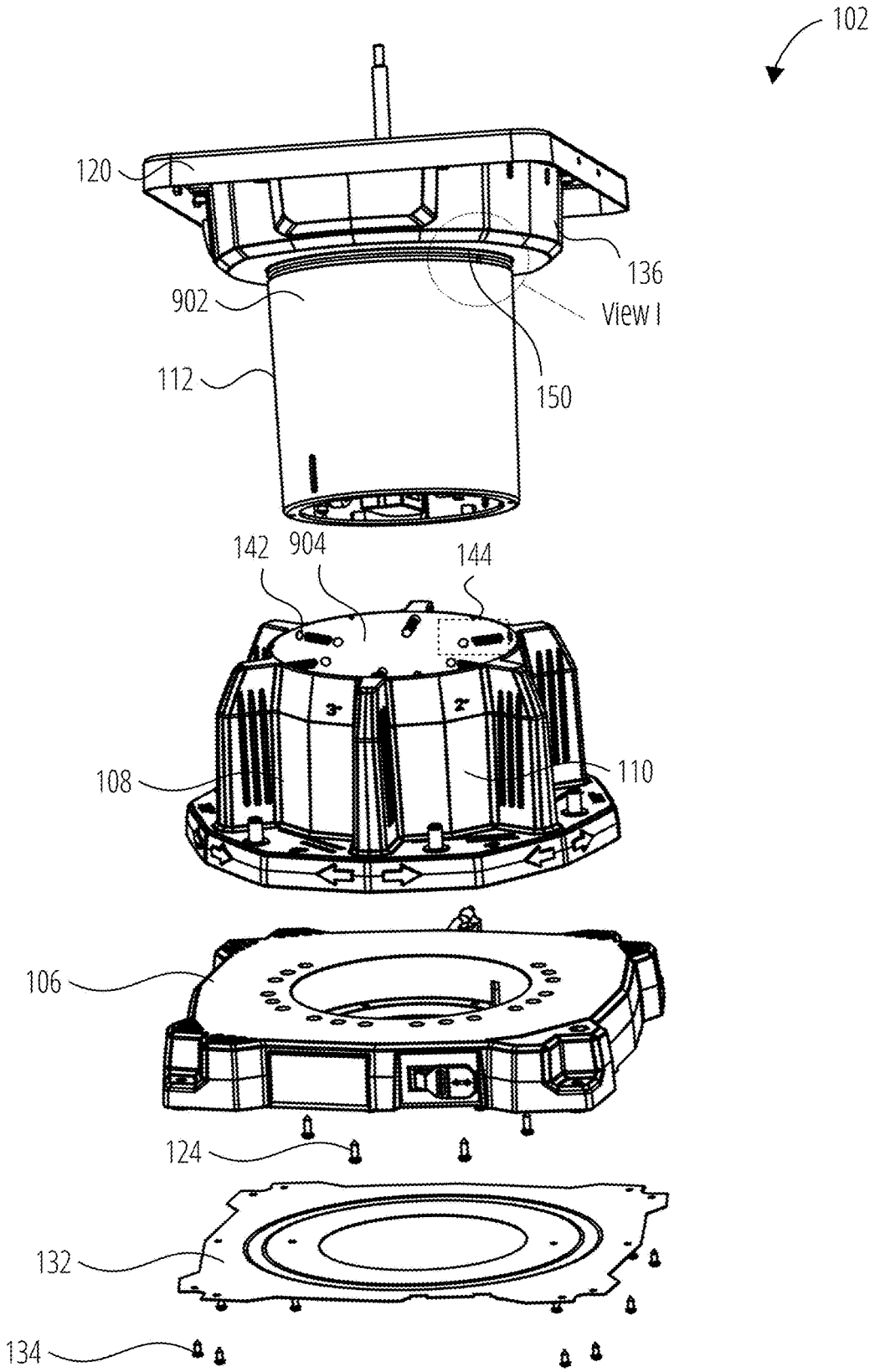
FIG. 9 is an exploded front perspective view of an oscillating spindle sander assembly, according to an example embodiment.
Figure 10A:
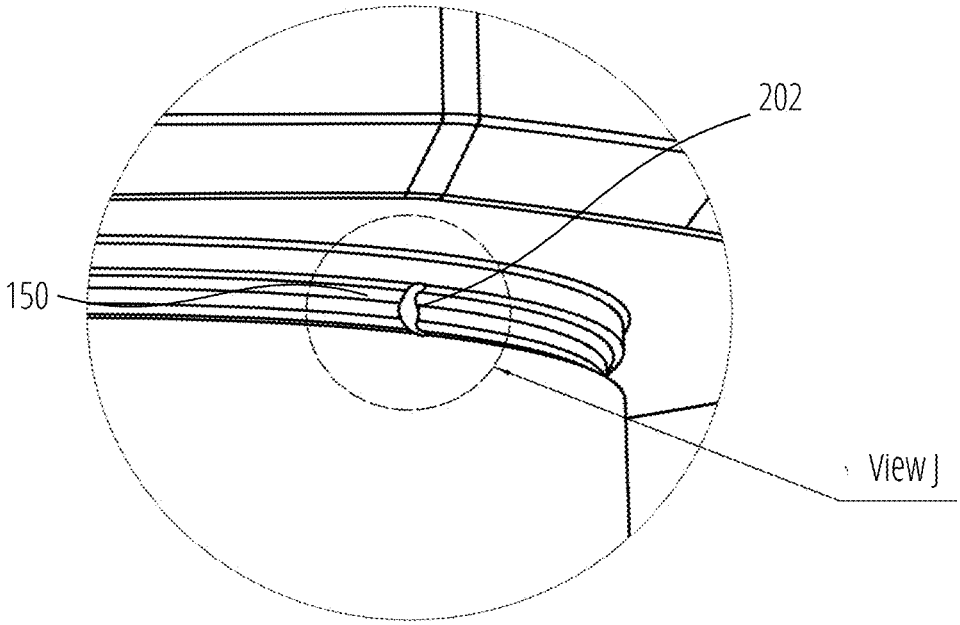
FIG. 10A is a partial view showing a circular groove of an oscillating spindle sander assembly, according to an example embodiment.
Figure 10B:
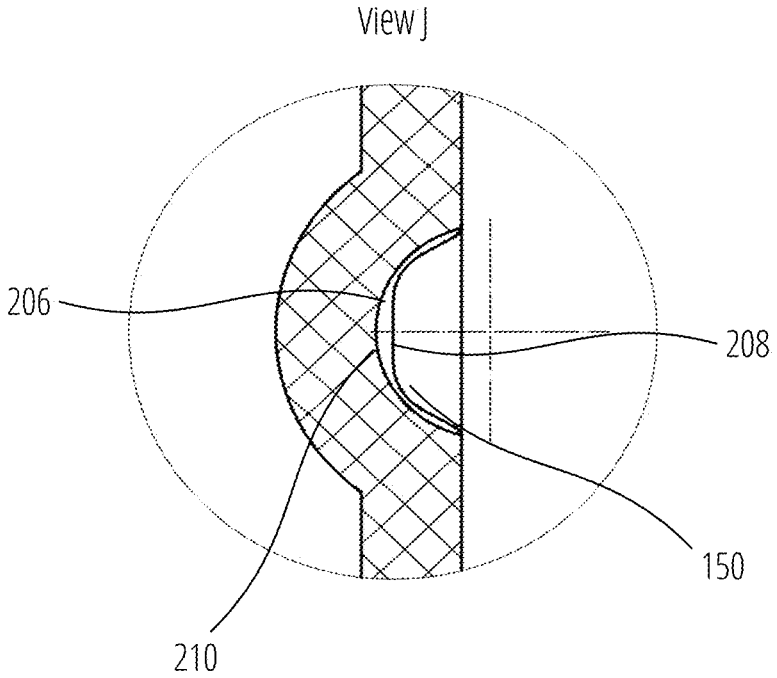
FIG. 10B is a partial cross-section view illustrating a dent, according to an example embodiment.

FIG. 9, FIG. 10A, and FIG. 10B illustrate an example embodiment, in which the circular groove 150 is arranged on an external cylinder surface 902 of the oscillation generator 112. The rotary compartment drum 108 may include an internal cylinder surface 904. The internal cylinder surface 904 of the rotary compartment drum 108 may face the external cylinder surface 902 of the oscillation generator 112. As shown in FIG. 9, the oscillation generator 112 may include the circular groove 150 made on the external cylinder surface 902 of the oscillation generator 112. The rotary compartment drum 108 may include the plurality of recesses 142 distributed along the internal cylinder surface 904 of the rotary compartment drum 108. The plurality of securing components 144 may be placed in the plurality of recesses 142.

FIG. 10A is a partial view I of FIG. 9 showing the circular groove 150 made on the external cylinder surface 902 of the oscillation generator 112, according to an example embodiment. One or more dents 202 may be made in the circular groove 150.

The plurality of securing components 144 may sink inside the one or more dents 202 and push the rotary compartment drum 108 away from the oscillation generator 112.

FIG. 10B is a partial cross-section view J of FIG. 10A illustrating a dent 206 of the one or more dents 202, according to an example embodiment. The dent 206 may have a bottom side 210 deeper than the circular groove 150.

Upon rotation of the rotary compartment drum 108 around the oscillation generator 112, a securing component 204 of the plurality of securing components 144 rises out of a first dent 206 of the one or more dents 202, rolls along the circular groove 150, and sinks inside a second dent 206 of the one or more dents 202. The rotation of the rotary compartment drum 108 includes rotation of the plurality of storage compartments 110 around the oscillation generator 112.

Figure 11:
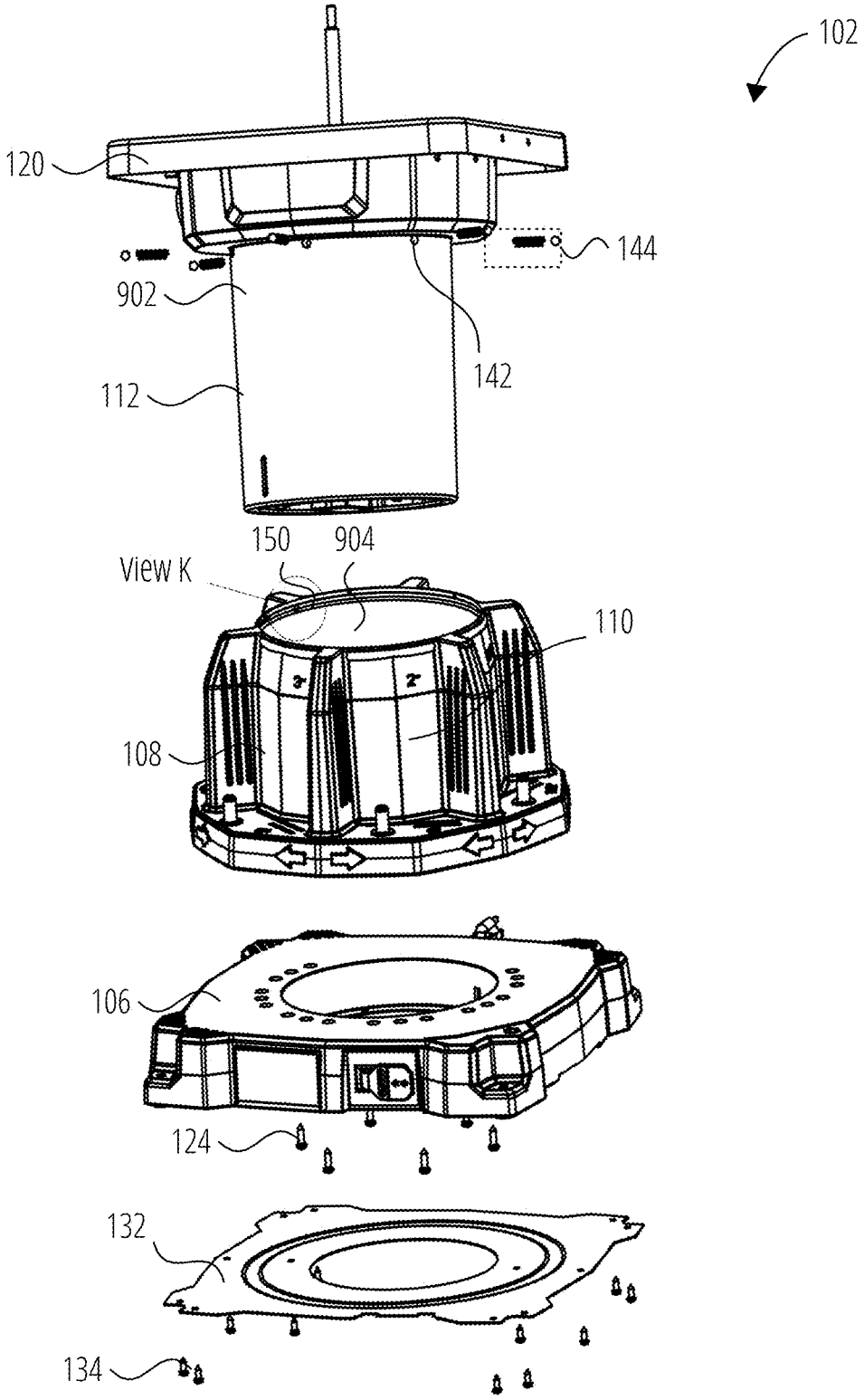
FIG. 11 is an exploded front perspective view of an oscillating spindle sander assembly, according to an example embodiment.
Figure 12A:
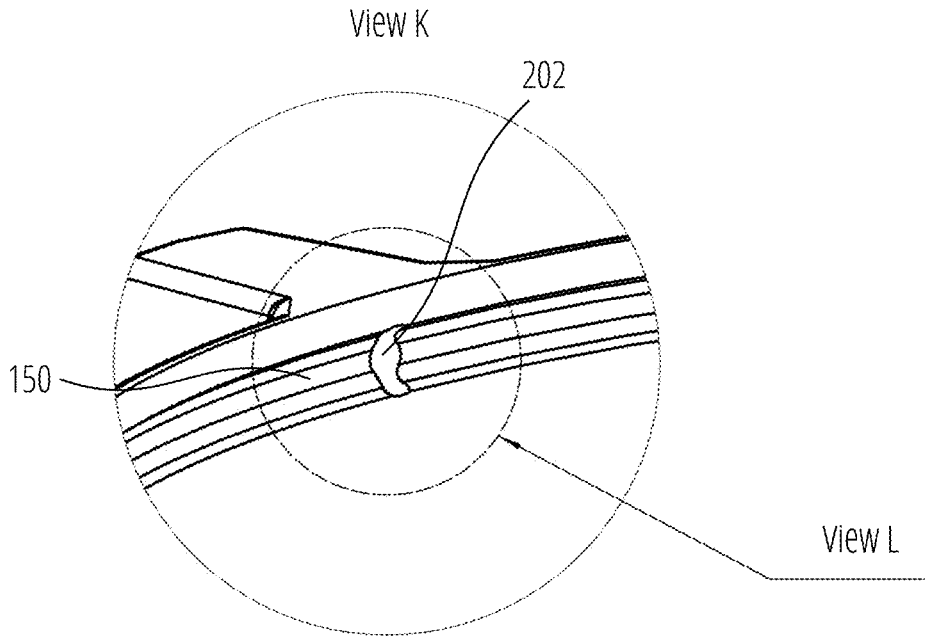
FIG. 12A is a partial view showing a circular groove of an oscillating spindle sander assembly, according to an example embodiment.
Figure 12B:
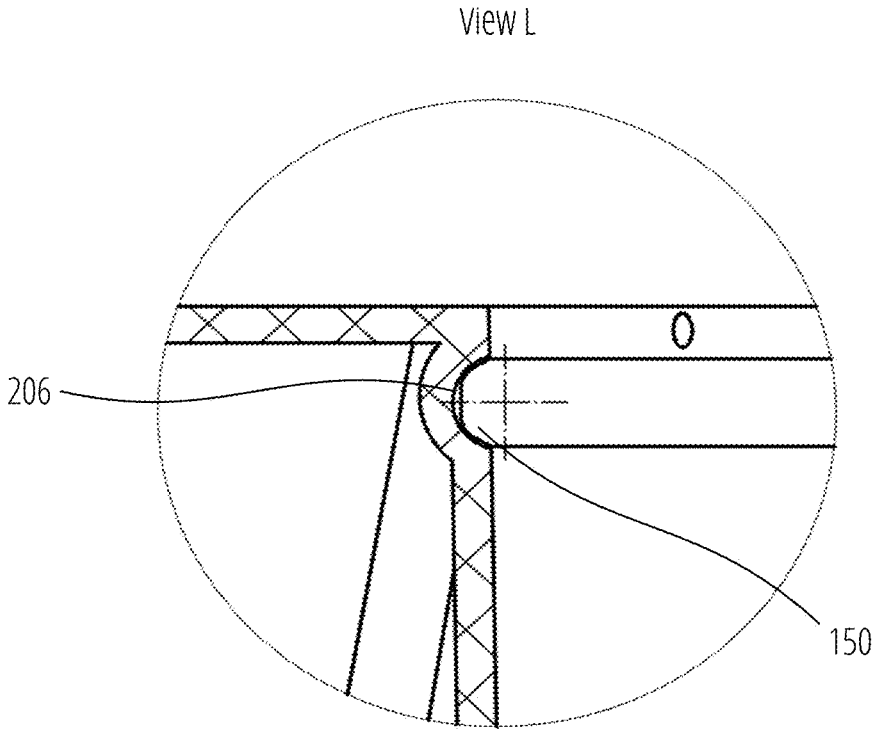
FIG. 12B is a partial cross-section view illustrating a dent, according to an example embodiment.

FIG. 11, FIG. 12A, and FIG. 12B illustrate an example embodiment, in which the circular groove 150 is arranged on the internal cylinder surface 904 of the rotary compartment drum 108.

The oscillation generator 112 may include a plurality of recesses 142 distributed along the external cylinder surface 902 of the oscillation generator 112. A plurality of securing components 144 may be placed in the plurality of recesses 142. The rotary compartment drum 108 may include the circular groove 150 on the internal cylinder surface 904 of the rotary compartment drum 108.

FIG. 12A is a partial view K of FIG. 11 showing the circular groove 150 made on the internal cylinder surface 904 of the rotary compartment drum 108, according to an example embodiment. The rotary compartment drum 108 may further include one or more dents 202 made in the circular groove 150.

The plurality of securing components 144 sinks inside the one or more dents 202 and pushes the rotary compartment drum 108 away from the oscillation generator 112.

FIG. 12B is a partial cross-section view L of FIG. 12A illustrating a dent 206 of the one or more dents 202, according to an example embodiment.

Upon rotation of the rotary compartment drum 108 around the oscillation generator 112, a securing component 204 of the plurality of securing components 144 rises out of a first dent 206 of the one or more dents 202, rolls along the circular groove 150, and sinks inside a second dent 206 of the one or more dents 202. The rotation of the rotary compartment drum 108 includes rotation of the plurality of storage compartments 110 around the oscillation generator 112.

Figure 13:
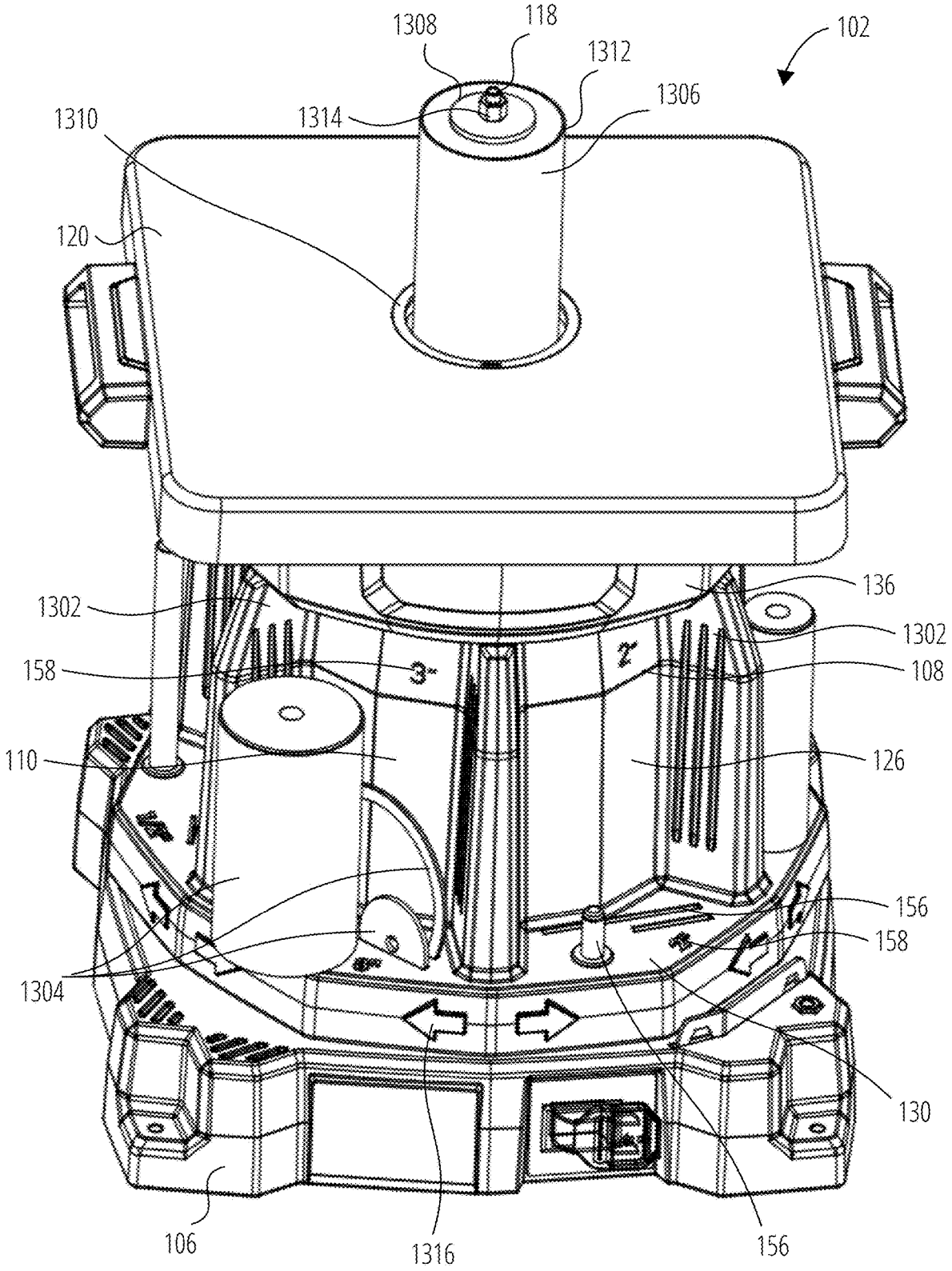
FIG. 13 is a top perspective view of an oscillating spindle sander assembly, according to an example embodiment.
Figure 14:
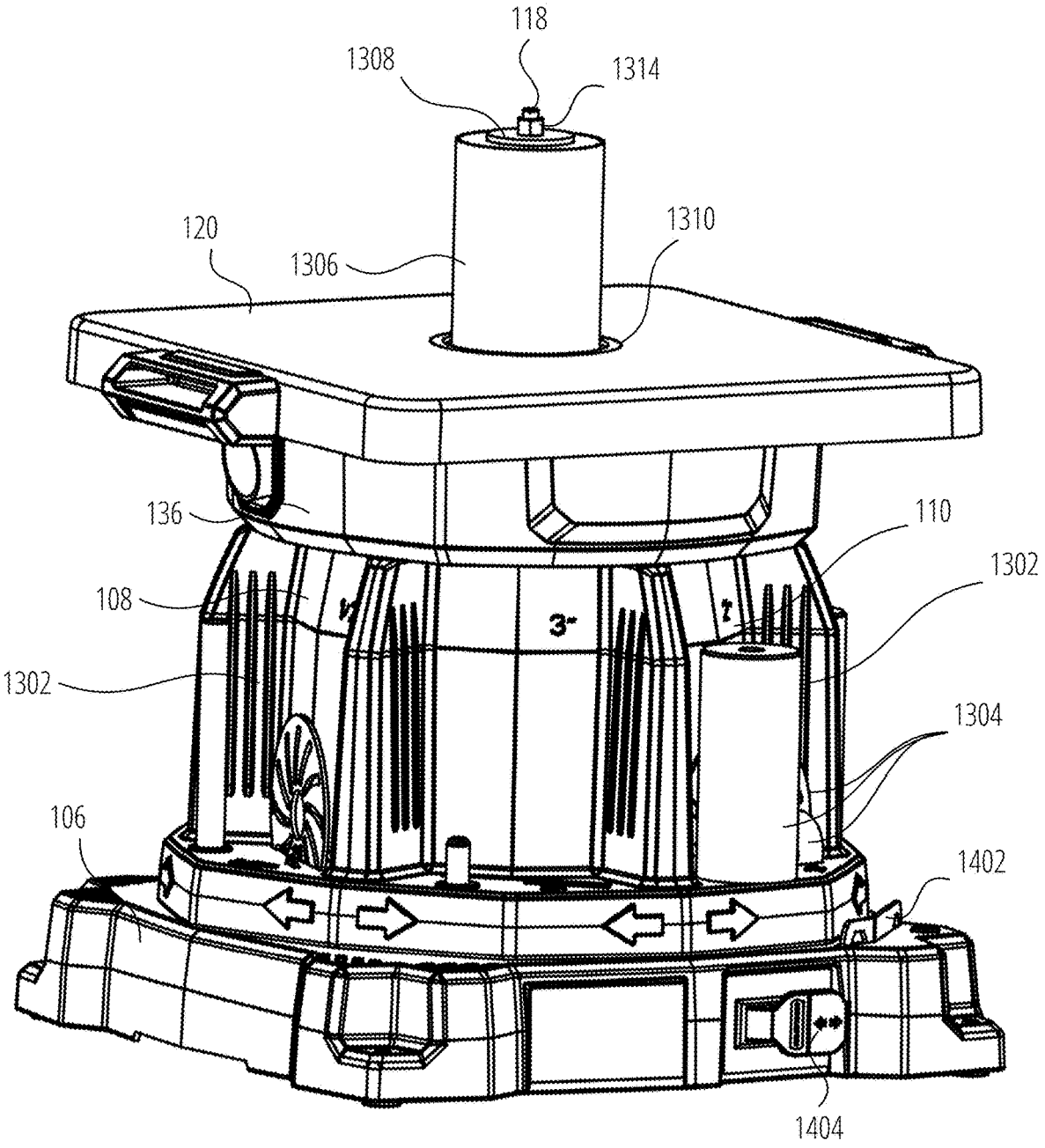
FIG. 14 is a front perspective view of an oscillating spindle sander assembly, according to an example embodiment.

FIG. 13 is a top perspective view of the oscillating spindle sander assembly 102, according to an example embodiment. FIG. 14 is a front perspective view of the oscillating spindle sander assembly 102, according to an example embodiment. FIG. 13 and FIG. 14 illustrate storing a plurality of sets of accessories in the plurality of storage compartments 110.

The storage compartments 110 may be separated from each other by dividers 1302. A divider 1302 may include a rib standing on the support portion 130 of the rotary compartment drum 108 and connected to the substantially cylindrical surface 126 of the rotary compartment drum 108. Accordingly, each storage compartment of the plurality of storage compartments 110 is created by a portion of the substantially cylindrical surface 126 of the rotary compartment drum 108, a portion of the support portion 130 of the rotary compartment drum 108, and two adjacent dividers 1302.

Each of the plurality of storage compartments 110 may include a plurality of fixing components 156 for fixing a plurality of sets of accessories 1304 in the storage compartment 110. In an example embodiment, the plurality of fixing components 156 may be provided on the support portion 130 of the rotary compartment drum 108.

A set of accessories of the plurality of sets of accessories 1304 may include a sanding drum 1306, a drum washer 1308, and a table insert 1310. A sanding drum 1306 may have a sleeve 1312 and may slide on the drive shaft 118 of the oscillating spindle sander assembly 102, followed by a drum washer 1308 on the top and secured by a nut 1314. A table insert 1310 may be placed around the sanding drum 1306 with the sleeve 1312 to cover the opening 122 on the table 120.

In an example embodiment, the plurality of fixing components 156 may include a vertical rod for placing the sanding drum 1306 onto it, a recess for placing the drum washer 1308 into it, and a recess for placing the table insert 1310 into it.

The plurality of sets of accessories 1304 may be associated with a plurality of sizes of accessories. A storage compartment of the plurality of storage compartments 110 stores a set of accessories associated with one size of the plurality of sizes.

The sanding drum 1306, the drum washer 1308, and the table insert 1310 of the same size are stored in one storage compartment as one set of accessories of a particular size. With the rotation of the rotary compartment drum 108, the set of accessories of the desired size may be brought in front of the operator for easy access. The oscillating spindle sander assembly 102 may have arrows 1316 on the rotary compartment drum 108 to indicate a possible direction of rotation to the operator.

Each of the plurality of storage compartments 110 may have a label 158 showing the size of a set of accessories to be stored in this storage compartment. The label 158 may be provided on the substantially cylindrical surface 126 of the rotary compartment drum 108. The label 158 may also be duplicated on the support portion 130 of the rotary compartment drum 108. As the substantially cylindrical surface 126 is a vertically disposed component and the support portion 130 is a horizontally disposed component, placing one label 158 on the vertical surface and another label 158 on the horizontal surface may enable the operator to see the label 158 at any viewing angle. The labels 158 may be silk-printed or embossed on the rotary compartment drum 108.

In an example embodiment, the number of storage compartments arranged around the rotary compartment drum 108 may be equal to six, based on the standard number of sizes (½", ¾", 1", 1½", 2", and 3") of the sets of accessories for the oscillating spindle sander assembly 102.

As shown in FIG. 14, in an example embodiment, the oscillating spindle sander assembly 102 may further have a stamped wrench to handle the nut 1314. The oscillating spindle sander assembly 102 may further include a switch for switching a motor and drive unit of the oscillating spindle sander assembly 102. The stamped wrench 1402 and the switch 1404 may be disposed on the base 106 of the oscillating spindle sander assembly 102.

Figure 15:
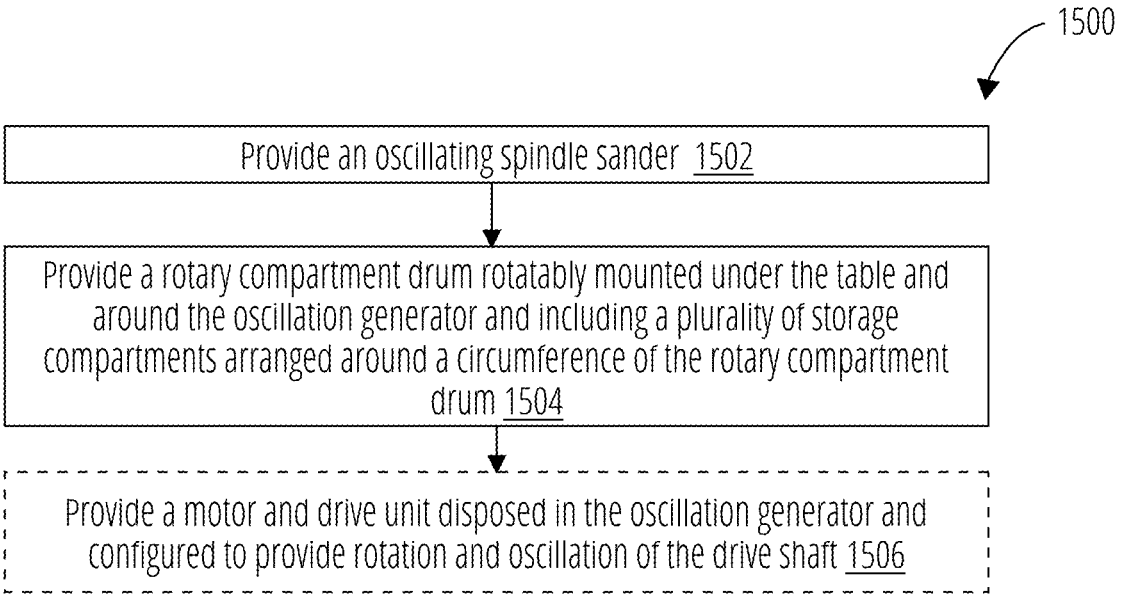
FIG. 15 is a flowchart illustrating a method for manufacturing an oscillating spindle sander assembly, according to an example embodiment.

FIG. 15 is a flow chart of a method 1500 for manufacturing an oscillating spindle sander assembly, according to an example embodiment. In some embodiments, the operations of the method 1500 may be combined, performed in parallel, or performed in a different order. The method 1500 may also include additional or fewer operations than those illustrated.

In block 1502, the method 1500 may commence with providing an oscillating spindle sander. The oscillating spindle sander may include an oscillation generator, a drive shaft, and a table. The drive shaft may extend outwards from the oscillation generator. The table may be disposed above the oscillation generator and may have an opening accommodating the drive shaft.

The method 1500 may further include providing, in block 1504, a rotary compartment drum. The rotary compartment drum may be rotatably mounted under the table and around the oscillation generator. The rotary compartment drum may include a plurality of storage compartments arranged around a circumference of the rotary compartment drum.

The oscillating spindle sander may include a resting member disposed under the table. The resting member may include a bottom surface placed onto the rotary compartment drum. The rotary compartment drum may include a top surface facing the resting member. The top surface of the rotary compartment drum may be in contact with the bottom surface of the resting member.

In an example embodiment, the resting member may include a circular groove located on the bottom surface. One or more dents may be made in the circular groove. The rotary compartment drum may include a plurality of recesses distributed along the top surface and a plurality of securing components placed in the plurality of recesses. A securing component of the plurality of securing components may be designed to sink inside a first dent of the one or more dents and push the rotary compartment drum away from the resting member. Upon rotation of the rotary compartment drum around the oscillation generator, the securing component of the plurality of securing components may be configured to rise out of the first dent of the one or more dents, roll along the circular groove, and sink inside a second dent of the one or more dents. Rotation of the rotary compartment drum may include rotation of the plurality of storage compartments around the oscillation generator. The securing component of the plurality of securing components may include a spring and a ball. The spring may be placed into a recess of the plurality of recesses. The ball may be placed onto the spring.

In another example embodiment, the resting member may include a plurality of recesses distributed along the bottom surface and a plurality of securing components placed in the plurality of recesses. The rotary compartment drum may include a circular groove and one or more dents made in the circular groove. A securing component of the plurality of securing components may be configured to sink inside a first dent of the one or more dents and push the rotary compartment drum away from the resting member. Upon rotation of the rotary compartment drum around the oscillation generator, the securing component of the plurality of securing components may be configured to rise out of the first dent of the one or more dents, roll along the circular groove, and sink inside a second dent of the one or more dents. Rotation of the rotary compartment drum may include rotation of the plurality of storage compartments around the oscillation generator. The securing component of the plurality of securing components may include a spring placed into a recess of the plurality of recesses and a ball placed onto the spring.

The oscillating spindle sander may further include a base disposed under the oscillation generator. The base may include a top surface facing the rotary compartment drum. The rotary compartment drum may include a bottom surface facing the base. The bottom surface of the rotary compartment drum may be in contact with the top surface of the base. The base may be connected to the oscillation generator via a plurality of first fastening components.

In an example embodiment, the base may include a circular groove located onto the top surface and one or more dents made in the circular groove. The rotary compartment drum may include a plurality of recesses distributed along the bottom surface and a plurality of securing components placed in the plurality of recesses. A securing component of the plurality of securing components may be configured to sink inside a first dent of the one or more dents and push the rotary compartment drum away from the base. Upon rotation of the rotary compartment drum around the oscillation generator, the securing component of the plurality of securing components may be configured to rise out of the first dent of the one or more dents, roll along the circular groove, and sink inside a second dent of the one or more dents. Rotation of the rotary compartment drum may include rotation of the plurality of storage compartments around the oscillation generator. The securing component may include a spring placed into a recess of the plurality of recesses and a ball placed onto the spring.

In another example embodiment, the base may include a plurality of recesses distributed along the top surface and a plurality of securing components placed in the plurality of recesses. The rotary compartment drum may include a circular groove on the bottom surface and one or more dents made in the circular groove. A securing component of the plurality of securing components may be configured to sink inside a first dent of the one or more dents and push the rotary compartment drum away from the base. Upon rotation of the rotary compartment drum around the oscillation generator, the securing component of the plurality of securing components may rise out of a first dent of the one or more dents, roll along the circular groove, and sink inside a second dent of the one or more dents. Rotation of the rotary compartment drum may include rotation of the plurality of storage compartments around the oscillation generator. The securing component of the plurality of securing components may include a spring placed into a recess of the plurality of recesses and a ball placed onto the spring.

The oscillation generator may further include an external cylinder surface. The rotary compartment drum may include an internal cylinder surface. The internal cylinder surface of the rotary compartment drum may face the external cylinder surface of the oscillation generator.

In an example embodiment, the oscillation generator may include a circular groove on the external cylinder surface and one or more dents made in the circular groove. The rotary compartment drum may include a plurality of recesses distributed along the internal cylinder surface and a plurality of securing components placed in the plurality of recesses. A securing component of the plurality of securing components may be configured to sink inside a first dent of the one or more dents and push the rotary compartment drum away from the oscillation generator. Upon rotation of the rotary compartment drum around the oscillation generator, the securing component of the plurality of securing components may be configured to rise out of the first dent of the one or more dents, roll along the circular groove, and sink inside a second dent of the one or more dents. Rotation of the rotary compartment drum may include rotation of the plurality of storage compartments around the oscillation generator. The securing component of the plurality of securing components may include a spring placed into a recess of the plurality of recesses and a ball placed onto the spring.

In another example embodiment, the oscillation generator may include a plurality of recesses distributed along the external cylinder surface and a plurality of securing components placed in the plurality of recesses. The rotary compartment drum may include a circular groove on the internal cylinder surface and one or more dents made in the circular groove. A securing component of the plurality of securing components may be configured to sink inside a first dent of the one or more dents and push the rotary compartment drum away from the oscillation generator. Upon rotation of the rotary compartment drum around the oscillation generator, a securing component of the plurality of securing components may rise out of a first dent of the one or more dents, roll along the circular groove, and sinks inside a second dent of the one or more dents. The rotation of the rotary compartment drum may include rotation of the plurality of storage compartments around the oscillation generator. The securing component of the plurality of securing components may include a spring placed into a recess of the plurality of recesses and a ball placed onto the spring.

The plurality of storage compartments may include a plurality of fixing components for fixing a plurality of sets of accessories in the plurality of storage compartments. A set of accessories of the plurality of sets of accessories may include a sanding drum, a drum washer, and a table insert. The plurality of sets of accessories may be associated with a plurality of sizes of accessories. A storage compartment of the plurality of storage compartments may store a set of accessories associated with a size of the plurality of sizes.

The method 1500 may further optionally include providing, in block 1506, a motor and drive unit disposed in the oscillation generator and configured to provide rotation and oscillation of the drive shaft.

Thus, an oscillating spindle sander assembly and a method for manufacturing an oscillating spindle sander assembly have been described. Although embodiments have been described with reference to specific example embodiments, it will be evident that various modifications and changes can be made to these example embodiments without departing from the broader spirit and scope of the present application. Accordingly, the specification and drawings are to be regarded in an illustrative rather than a restrictive sense.

What is claimed is:

1. An oscillating spindle sander assembly comprising:
an oscillating spindle sander including:
an oscillation generator;
a drive shaft extending outwards from the oscillation generator; and
a table disposed above the oscillation generator and having an opening accommodating the drive shaft;
a rotary compartment drum rotatably mounted under the table and around the oscillation generator and including a plurality of storage compartments arranged around a circumference of the rotary compartment drum; and
a plurality of securing components, each securing component being configured to selectively retain the rotary compartment drum at a corresponding one of a plurality of predetermined angular positions during rotation about the oscillation generator.

2. The oscillating spindle sander assembly of claim 1, wherein:
the oscillating spindle sander includes a resting member disposed under the table, the resting member including a bottom surface placed onto the rotary compartment drum;
the rotary compartment drum includes a top surface facing the resting member; and
the top surface of the rotary compartment drum is in contact with the bottom surface of the resting member.

3. The oscillating spindle sander assembly of claim 2, wherein:
the resting member includes:
a circular groove located on the bottom surface; and
one or more dents made in the circular groove;
the rotary compartment drum includes
a plurality of recesses distributed along the top surface; and
the plurality of securing components are placed in the plurality of recesses,
wherein a securing component of the plurality of securing components is designed to:
sink inside a first dent of the one or more dents; and
push the rotary compartment drum away from the resting member.

4. The oscillating spindle sander assembly of claim 3, wherein, upon rotation of the rotary compartment drum around the oscillation generator, the securing component of the plurality of securing components is designed to:
rise out of the first dent of the one or more dents;
roll along the circular groove; and
sink inside a second dent of the one or more dents, and wherein rotation of the rotary compartment drum includes rotation of the plurality of storage compartments around the oscillation generator.

5. The oscillating spindle sander assembly of claim 4, wherein the securing component of the plurality of securing components includes:
a spring placed into a recess of the plurality of recesses; and
a ball placed onto the spring.

6. The oscillating spindle sander assembly of claim 2, wherein:
the resting member includes
a plurality of recesses distributed along the bottom surface;
the plurality of securing components are placed in the plurality of recesses;
and
the rotary compartment drum includes:
a circular groove; and
one or more dents made in the circular groove, wherein a securing component of the plurality of securing components is designed to:
sink inside a first dent of the one or more dents; and
push the rotary compartment drum away from the resting member.

7. The oscillating spindle sander assembly of claim 6, wherein, upon rotation of the rotary compartment drum around the oscillation generator, the securing component of the plurality of securing components is designed to:
rise out of the first dent of the one or more dents;
roll along the circular groove; and
sink inside a second dent of the one or more dents, wherein rotation of the rotary compartment drum includes rotation of the plurality of storage compartments around the oscillation generator.

8. The oscillating spindle sander assembly of claim 7, wherein the securing component of the plurality of securing components includes:
a spring placed into a recess of the plurality of recesses; and
a ball placed onto the spring.

9. The oscillating spindle sander assembly of claim 1, wherein:
the oscillating spindle sander includes a base disposed under the oscillation generator, the base including a top surface facing the rotary compartment drum;
the rotary compartment drum includes a bottom surface facing the base; and
the bottom surface of the rotary compartment drum is contact with the top surface of the base.

10. The oscillating spindle sander assembly of claim 9, wherein the base is connected to the oscillation generator via a plurality of first fastening components.

11. The oscillating spindle sander assembly of claim 9, wherein:
the base includes:
a circular groove located onto the top surface; and
one or more dents made in the circular groove; and
the rotary compartment drum includes
a plurality of recesses distributed along the bottom surface;
the plurality of securing components are placed in the plurality of recesses, wherein a securing component of the plurality of securing components is designed to:
sink inside a first dent of the one or more dents; and
push the rotary compartment drum away from the base.

12. The oscillating spindle sander assembly of claim 11, wherein, upon rotation of the rotary compartment drum around the oscillation generator, the securing component of the plurality of securing components is designed to:
rise out of the first dent of the one or more dents;
roll along the circular groove; and
sink inside a second dent of the one or more dents, wherein rotation of the rotary compartment drum includes rotation of the plurality of storage compartments around the oscillation generator.

13. The oscillating spindle sander assembly of claim 12, wherein the securing component includes:
a spring placed into a recess of the plurality of recesses; and
a ball placed onto the spring.

14. The oscillating spindle sander assembly of claim 9, wherein:
the base includes
a plurality of recesses distributed along the top surface;
the plurality of securing components are placed in the plurality of recesses;
and
the rotary compartment drum includes:
a circular groove on the bottom surface; and
one or more dents made in the circular groove, wherein a securing component of the plurality of securing components is designed to:
sink inside a first dent of the one or more dents; and
push the rotary compartment drum away from the base.

15. The oscillating spindle sander assembly of claim 14, wherein, upon rotation of the rotary compartment drum around the oscillation generator, the securing component of the plurality of securing components:
rises out of a first dent of the one or more dents;
rolls along the circular groove; and
sinks inside a second dent of the one or more dents, wherein rotation of the rotary compartment drum includes rotation of the plurality of storage compartments around the oscillation generator.

16. The oscillating spindle sander assembly of claim 15, wherein the securing component of the plurality of securing components includes:
a spring placed into a recess of the plurality of recesses; and
a ball placed onto the spring.

17. The oscillating spindle sander assembly of claim 1, wherein:
the oscillation generator further includes an external cylinder surface;
the rotary compartment drum includes an internal cylinder surface; and
the internal cylinder surface of the rotary compartment drum faces the external cylinder surface of the oscillation generator.

18. The oscillating spindle sander assembly of claim 17, wherein:
the oscillation generator includes:
a circular groove on the external cylinder surface; and
one or more dents made in the circular groove; and
the rotary compartment drum includes
a plurality of recesses distributed along the internal cylinder surface;
the plurality of securing components are placed in the plurality of recesses, wherein a securing component of the plurality of securing components is designed to:
sink inside a first dent of the one or more dents; and
push the rotary compartment drum away from the oscillation generator.

19. The oscillating spindle sander assembly of claim 18, wherein, upon rotation of the rotary compartment drum around the oscillation generator, the securing component of the plurality of securing components is designed to:
rise out of the first dent of the one or more dents;
roll along the circular groove; and
sink inside a second dent of the one or more dents, wherein rotation of the rotary compartment drum includes rotation of the plurality of storage compartments around the oscillation generator.

20. The oscillating spindle sander assembly of claim 19, wherein the securing component of the plurality of securing components includes:
a spring placed into a recess of the plurality of recesses; and
a ball placed onto the spring.

21. The oscillating spindle sander assembly of claim 17, wherein:
the oscillation generator includes
a plurality of recesses distributed along the external cylinder surface;
the plurality of securing components are placed in the plurality of recesses;
and
the rotary compartment drum includes:
a circular groove on the internal cylinder surface; and
one or more dents made in the circular groove, wherein a securing component of the plurality of securing components is designed to:
sink inside a first dent of the one or more dents; and
push the rotary compartment drum away from the oscillation generator.

22. The oscillating spindle sander assembly of claim 21, wherein, upon rotation of the rotary compartment drum around the oscillation generator, a securing component of the plurality of securing components is configured to:
rise out of a first dent of the one or more dents;
roll along the circular groove; and
sinks inside a second dent of the one or more dents, wherein the rotation of the rotary compartment drum includes rotation of the plurality of storage compartments around the oscillation generator.

23. The oscillating spindle sander assembly of claim 22, wherein the securing component of the plurality of securing components includes:
a spring placed into a recess of the plurality of recesses; and
a ball placed onto the spring.

24. The oscillating spindle sander assembly of claim 1, wherein the plurality of storage compartments includes a plurality of fixing components for fixing a plurality of sets of accessories in the plurality of storage compartments.

25. The oscillating spindle sander assembly of claim 24, wherein a set of accessories of the plurality of sets of accessories includes a sanding drum, a drum washer, and a table insert.

26. The oscillating spindle sander assembly of claim 24, wherein:
the plurality of sets of accessories is associated with a plurality of sizes of accessories; and
a storage compartment of the plurality of storage compartments stores a set of accessories associated with a size of the plurality of sizes.

27. The oscillating spindle sander assembly of claim 1, further comprising a motor and drive unit disposed in the oscillation generator and configured to provide rotation and oscillation of the drive shaft.

28. A method for manufacturing an oscillating spindle sander assembly, the method comprising:
providing an oscillating spindle sander including:
an oscillation generator;
a drive shaft extending outwards from the oscillation generator; and
a table disposed above the oscillation generator and having an opening accommodating the drive shaft;
providing a rotary compartment drum rotatably mounted under the table and around the oscillation generator and including a plurality of storage compartments arranged around a circumference of the rotary compartment drum; and providing a plurality of securing components, each securing component being configured to selectively retain the rotary compartment drum at a corresponding one of a plurality of predetermined angular positions during rotation about the oscillation generator.

29. The method of claim 28, wherein:

the oscillating spindle sander includes a resting member disposed under the table, the resting member including a bottom surface placed onto the rotary compartment drum;

the rotary compartment drum includes a top surface facing the resting member; and the top surface of the rotary compartment drum is in contact with the bottom surface of the resting member.

30. The method of claim 29, wherein:

the resting member includes:

a circular groove located on the bottom surface; and one or more dents made in the circular groove; and the rotary compartment drum includes a plurality of recesses distributed along the top surface;

the plurality of securing components are placed in the plurality of recesses, wherein a securing component of the plurality of securing components is designed to:

sink inside a first dent of the one or more dents; and push the rotary compartment drum away from the resting member;

wherein, upon rotation of the rotary compartment drum around the oscillation generator, the securing component of the plurality of securing components is designed to:

rise out of the first dent of the one or more dents;

roll along the circular groove; and sink inside a second dent of the one or more dents, and wherein rotation of the rotary compartment drum includes rotation of the plurality of storage compartments around the oscillation generator;

wherein the securing component of the plurality of securing components includes:

a spring placed into a recess of the plurality of recesses; and a ball placed onto the spring.

31. The method of claim 29, wherein:

the resting member includes a plurality of recesses distributed along the bottom surface;

the plurality of securing components are placed in the plurality of recesses;

and the rotary compartment drum includes:

a circular groove; and one or more dents made in the circular groove, wherein a securing component of the plurality of securing components is designed to:

sink inside a first dent of the one or more dents; and push the rotary compartment drum away from the resting member;

wherein, upon rotation of the rotary compartment drum around the oscillation generator, the securing component of the plurality of securing components is designed to:

rise out of the first dent of the one or more dents;

roll along the circular groove; and sink inside a second dent of the one or more dents, wherein rotation of the rotary compartment drum includes rotation of the plurality of storage compartments around the oscillation generator;

wherein the securing component of the plurality of securing components includes:

a spring placed into a recess of the plurality of recesses; and a ball placed onto the spring.

32. The method of claim 28, wherein:

the oscillating spindle sander includes a base disposed under the oscillation generator, the base including a top surface facing the rotary compartment drum;

the rotary compartment drum includes a bottom surface facing the base; and the bottom surface of the rotary compartment drum is contact with the top surface of the base;

wherein the base is connected to the oscillation generator via a plurality of first fastening components.

33. The method of claim 32, wherein:

the base includes:

a circular groove located onto the top surface; and one or more dents made in the circular groove; and the rotary compartment drum includes a plurality of recesses distributed along the bottom surface;

the plurality of securing components are placed in the plurality of recesses, wherein a securing component of the plurality of securing components is designed to:

sink inside a first dent of the one or more dents; and push the rotary compartment drum away from the base;

wherein, upon rotation of the rotary compartment drum around the oscillation generator, the securing component of the plurality of securing components is designed to:

rise out of the first dent of the one or more dents;

roll along the circular groove; and sink inside a second dent of the one or more dents, wherein rotation of the rotary compartment drum includes rotation of the plurality of storage compartments around the oscillation generator;

wherein the securing component includes:

a spring placed into a recess of the plurality of recesses; and a ball placed onto the spring.

34. The method of claim 32, wherein:

the base includes a plurality of recesses distributed along the top surface;

the plurality of securing components are placed in the plurality of recesses; and the rotary compartment drum includes:

a circular groove on the bottom surface; and one or more dents made in the circular groove, wherein a securing component of the plurality of securing components is designed to:

sink inside a first dent of the one or more dents; and push the rotary compartment drum away from the base;

wherein, upon rotation of the rotary compartment drum around the oscillation generator, the securing component of the plurality of securing components:

rises out of a first dent of the one or more dents;

rolls along the circular groove; and sinks inside a second dent of the one or more dents, wherein rotation of the rotary compartment drum includes rotation of the plurality of storage compartments around the oscillation generator;

wherein the securing component of the plurality of securing components includes:

a spring placed into a recess of the plurality of recesses; and a ball placed onto the spring.

35. The method of claim 28, wherein:

the oscillation generator further includes an external cylinder surface;

the rotary compartment drum includes an internal cylinder surface; and the internal cylinder surface of the rotary compartment drum faces the external cylinder surface of the oscillation generator.

36. The method of claim 35, wherein:

the oscillation generator includes:

a circular groove on the external cylinder surface; and one or more dents made in the circular groove; and the rotary compartment drum includes a plurality of recesses distributed along the internal cylinder surface;

the plurality of securing components are placed in the plurality of recesses, wherein a securing component of the plurality of securing components is designed to:

sink inside a first dent of the one or more dents; and push the rotary compartment drum away from the oscillation generator;

wherein, upon rotation of the rotary compartment drum around the oscillation generator, the securing component of the plurality of securing components is designed to:

rise out of the first dent of the one or more dents;

roll along the circular groove; and sink inside a second dent of the one or more dents, wherein rotation of the rotary compartment drum includes rotation of the plurality of storage compartments around the oscillation generator;

wherein the securing component of the plurality of securing components includes:

a spring placed into a recess of the plurality of recesses; and a ball placed onto the spring.

37. The method of claim 35, wherein:

the oscillation generator includes a plurality of recesses distributed along the external cylinder surface;

the plurality of securing components are placed in the plurality of recesses; and the rotary compartment drum includes:

a circular groove on the internal cylinder surface; and one or more dents made in the circular groove, wherein a securing component of the plurality of securing components is designed to:

sink inside a first dent of the one or more dents; and push the rotary compartment drum away from the oscillation generator;

wherein, upon rotation of the rotary compartment drum around the oscillation generator, the securing component of the plurality of securing components:

rise out of the first dent of the one or more dents;

roll along the circular groove; and sink inside a second dent of the one or more dents, wherein the rotation of the rotary compartment drum includes rotation of the plurality of storage compartments around the oscillation generator;

wherein the securing component of the plurality of securing components includes:

a spring placed into a recess of the plurality of recesses; and a ball placed onto the spring.

38. The method of claim 28, wherein the plurality of storage compartments includes a plurality of fixing components for fixing a plurality of sets of accessories in the plurality of storage compartments.

39. The method of claim 38, wherein a set of accessories of the plurality of sets of accessories includes a sanding drum, a drum washer, and a table insert.

40. The method of claim 38, wherein:

the plurality of sets of accessories is associated with a plurality of sizes of accessories; and a storage compartment of the plurality of storage compartments stores a set of accessories associated with a size of the plurality of sizes.

41. The method of claim 28, further comprising providing a motor and drive unit disposed in the oscillation generator and configured to provide rotation and oscillation of the drive shaft.

* * * * *